US010544979B2

(12) United States Patent
Clark et al.

(10) Patent No.: US 10,544,979 B2
(45) Date of Patent: Jan. 28, 2020

(54) APPLIANCE AND METHOD OF CONTROLLING THE APPLIANCE

(71) Applicant: Whirlpool Corporation, Benton Harbor, MI (US)

(72) Inventors: Taylor N. Clark, St. Joseph, MI (US); Murilo P. Almeida, St. Joseph, MI (US); Victor S. Carlotto, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 118 days.

(21) Appl. No.: 15/383,018

(22) Filed: Dec. 19, 2016

(65) Prior Publication Data

US 2018/0172342 A1 Jun. 21, 2018

(51) Int. Cl.
*F25D 11/02* (2006.01)

(52) U.S. Cl.
CPC ..... *F25D 11/022* (2013.01); *F25B 2500/26* (2013.01); *F25B 2600/2511* (2013.01); *F25D 2700/12* (2013.01); *F25D 2700/122* (2013.01)

(58) Field of Classification Search
CPC .... F25D 11/022; F25D 11/02; F25D 2700/12; F25D 2700/122; F25D 2700/121; F25B 2600/2505; F25B 2600/2511; F25B 2600/2515; F25B 2500/26
See application file for complete search history.

(56) References Cited

U.S. PATENT DOCUMENTS 3,537,274 A 11/1970 Tilney
4,270,364 A 6/1981 Oonishi et al.
4,439,998 A 4/1984 Horvay et al.
4,513,581 A 4/1985 Mizobuchi et al.
5,465,591 A 11/1995 Cur et al.
5,758,510 A 6/1998 Cho
5,787,718 A * 8/1998 Jeong ..... F25D 11/022 62/157
6,167,712 B1 1/2001 Lim et al.
6,185,948 B1 2/2001 Niki et al.
6,460,357 B1 10/2002 Doi et al.
6,758,053 B2 7/2004 Kim et al.
6,931,870 B2 8/2005 Kim et al.
(Continued)

FOREIGN PATENT DOCUMENTS

DE 4020537 1/1992
EP 0246465 11/1987
(Continued)

*Primary Examiner* — Jianying C Atkisson
*Assistant Examiner* — Tavia Sullens
(74) *Attorney, Agent, or Firm* — Diederiks & Whitelaw, PLC.

(57) ABSTRACT

An appliance includes a first compartment and a second compartment. A temperature of the first compartment is determined with a first temperature sensor, and a temperature of the second compartment is determined with a second temperature sensor. If the temperature of the first compartment is above a first predetermined value and the temperature of the second compartment is above a second predetermined value, a controller causes the appliance to enter a pulldown mode. Upon entering the pulldown mode, the controller causes a valve to enter a first position where refrigerant flows to a freezer evaporator and is prevented from flowing to a fresh food evaporator.

18 Claims, 4 Drawing Sheets

(56) References Cited

U.S. PATENT DOCUMENTS

| | | | | |
|---|---|---|---|---|
| 6,935,127 | B2 | 8/2005 | Jeong et al. | |
| 7,137,266 | B2 | 11/2006 | Kim et al. | |
| 7,237,395 | B2 | 7/2007 | Rafalovich et al. | |
| 7,506,520 | B2 | 3/2009 | Oh | |
| 7,533,537 | B2 | 5/2009 | Rafalovich et al. | |
| 7,765,815 | B2 | 8/2010 | Yoon et al. | |
| 8,459,049 | B2 | 6/2013 | Li | |
| 9,182,158 | B2 | 11/2015 | Wu | |
| 2004/0074247 | A1 | 4/2004 | Peruzzo et al. | |
| 2007/0113567 | A1 | 5/2007 | Ahn et al. | |
| 2008/0190123 | A1 | 8/2008 | Li | |
| 2010/0179693 | A1* | 7/2010 | Sung | F25B 49/025 700/275 |
| 2012/0023975 | A1 | 2/2012 | Yoon et al. | |
| 2013/0061620 | A1* | 3/2013 | Li | F25D 11/022 62/126 |
| 2013/0111933 | A1 | 5/2013 | Yoon et al. | |
| 2014/0260377 | A1 | 9/2014 | Gomes et al. | |
| 2015/0121919 | A1 | 5/2015 | Lee et al. | |
| 2015/0276289 | A1 | 10/2015 | Gomes et al. | |
| 2015/0276306 | A1 | 10/2015 | Gomes et al. | |

FOREIGN PATENT DOCUMENTS

| | | |
|---|---|---|
| EP | 0602371 | 6/1994 |
| EP | 1030133 | 8/2000 |

* cited by examiner

APPLIANCE AND METHOD OF CONTROLLING THE APPLIANCE

BACKGROUND OF THE INVENTION

The present invention pertains to the art of refrigeration and, more particularly, to a pulldown mode and refrigeration system arrangement for an appliance.

In some appliances, a pulldown mode is entered when the temperature in one or more of the appliance's compartments exceeds a certain, relatively high value. This temperature value is generally not reached during normal operation but can be reached, for example, when the appliance is first turned on after purchase, the appliance loses power or is turned off for an extended period of time, or a substantial amount of warm food or beverages are loaded into the appliance.

The present invention relates to an improved pulldown mode that utilizes a particular refrigeration system arrangement and pulldown strategy in order to provide faster pulldown performance and allow for better management of the individual appliance compartments while reducing costs and software complexity.

SUMMARY OF THE INVENTION

The present invention is directed to an appliance and a method of controlling the appliance. The appliance includes a first compartment and a second compartment. A temperature of the first compartment is determined with a first temperature sensor, and a temperature of the second compartment is determined with a second temperature sensor. If the temperature of the first compartment is above a first predetermined value and the temperature of the second compartment is above a second predetermined value, a controller causes the appliance to enter a pulldown mode. Upon entering the pulldown mode, the controller causes a valve to enter a first position where refrigerant flows directly to a second evaporator and preferably is prevented from flowing to a first evaporator. Each compartment has a predetermined temperature value that triggers entry of the pulldown mode.

While the appliance is in the pulldown mode and the valve is in the first position, the temperature of the second compartment is determined. If the temperature of the second compartment falls below a third predetermined value, the controller causes the valve to enter a second position where refrigerant flows to both the second evaporator and the first evaporator. While the appliance is in the pulldown mode and the valve is in the second position, the temperature of the second compartment is determined. If the temperature of the second compartment rises above a fourth predetermined value, the controller causes the valve to return to the first position. The third predetermined value is preferably lower than the fourth predetermined value.

Also, while the appliance is in the pulldown mode, the temperatures of the first and second compartments are determined. If the temperature of the first compartment is below another, fifth predetermined value and the temperature of the second compartment is below further, sixth predetermined value, the controller causes the appliance to exit the pulldown mode. Upon exiting the pulldown mode, the controller causes the valve to enter the second position.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE PREFERRED EMBODIMENTS

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention. Furthermore, any temperature value listed herein includes a margin of error of +/−10° F. Accordingly, a temperature of 100° F. includes temperatures between 90° F. and 110° F. The term "approximately" increases the margin to 20° F.

Figure 1:
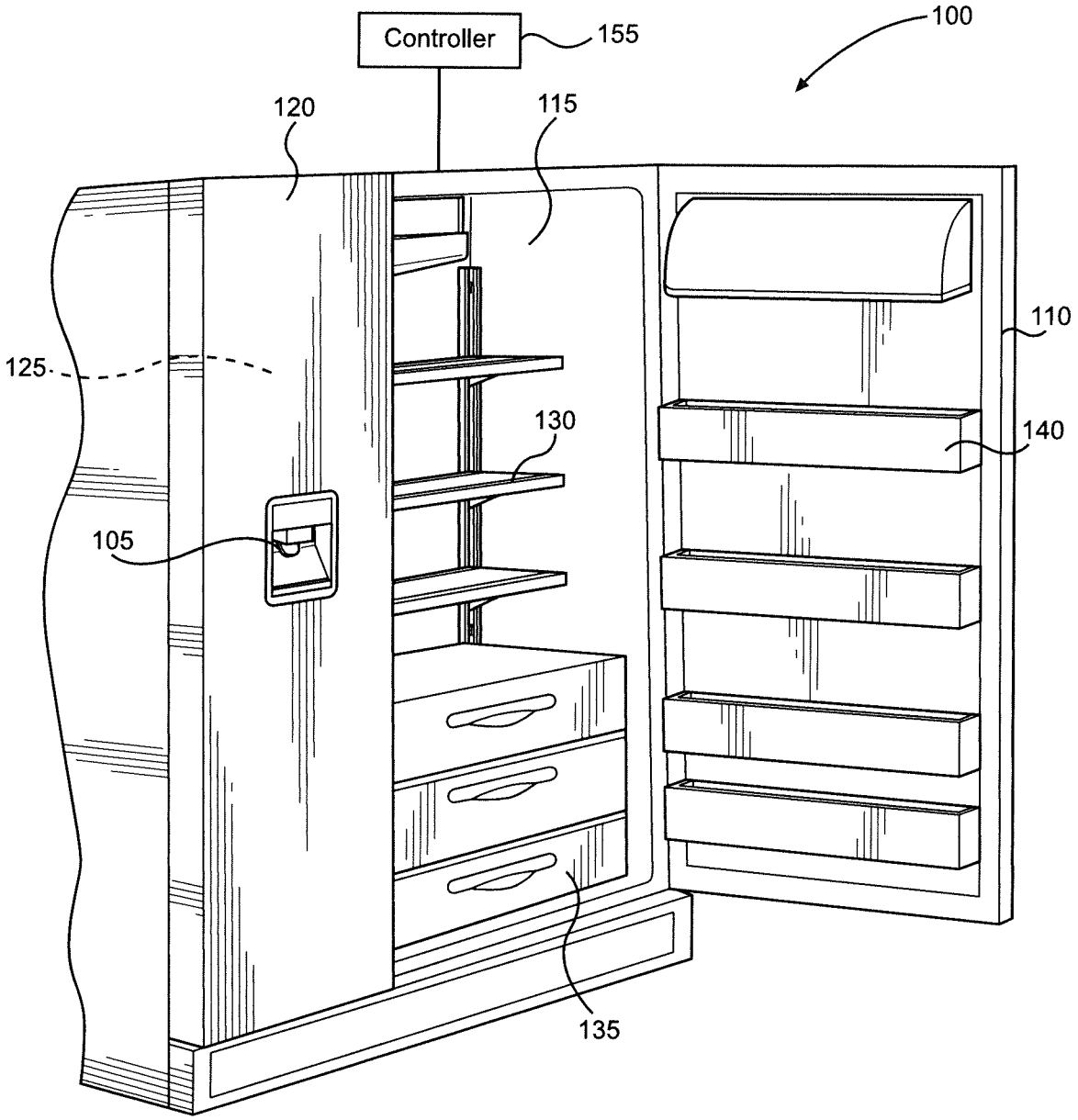
FIG. 1 is a perspective view of an appliance constructed in accordance with the present invention.

With initial reference to FIG. 1, there is illustrated an appliance 100 constructed in accordance with the present invention. Appliance 100 is shown in a side-by-side configuration, although the present invention can be used with other appliance configurations, including French door, bottom mount, single door, multi door and top mount configurations. Optionally, appliance 100 includes an ice and/or water dispenser 105, which selectively dispenses ice or water when desired by a user. Appliance 100 further includes a fresh food door 110, which selectively seals a first compartment 115, and a freezer door 120, which selectively seals a second compartment 125. For completeness, appliance 100 also includes a plurality of shelves (one of which is labeled 130), a plurality of drawers (one of which is labeled 135) and a plurality of door bins (one of which is labeled 140). Although not visible, appliance 100 includes a refrigeration system that employs a controller 155 establishes above and below freezing temperatures in compartments 115 and 125, as described in more detail below. In FIG. 1, appliance 100 is illustrated as a refrigerator including fresh food and freezer compartments (compartments 115 and 125, respectively). However, it should be understood that the present invention is not limited to refrigerators but can be used with other appliances.

Figure 2A:
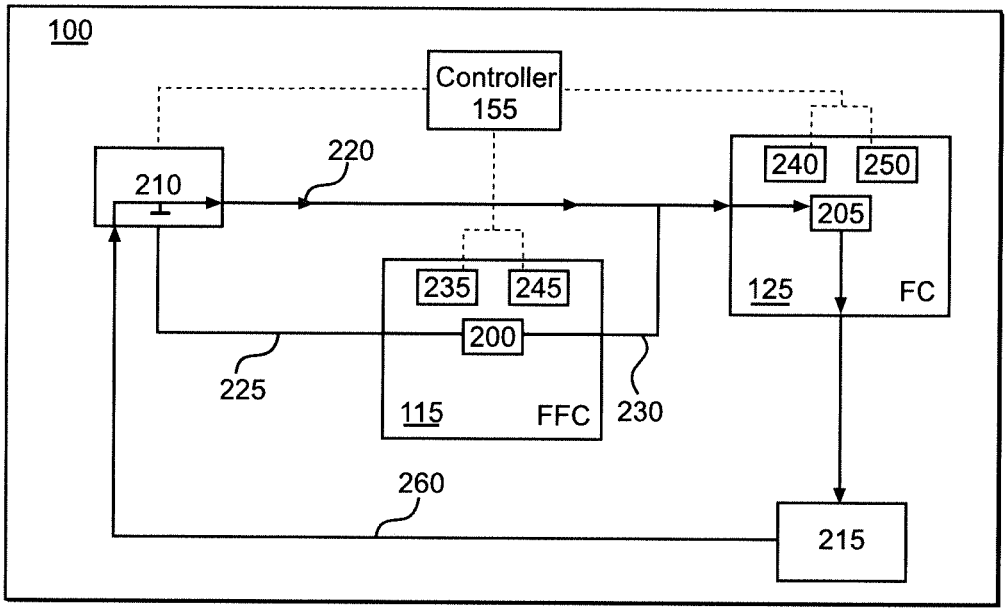
FIG. 2A is a schematic illustrating the appliance of FIG. 1 in a first operational mode.
Figure 2B:
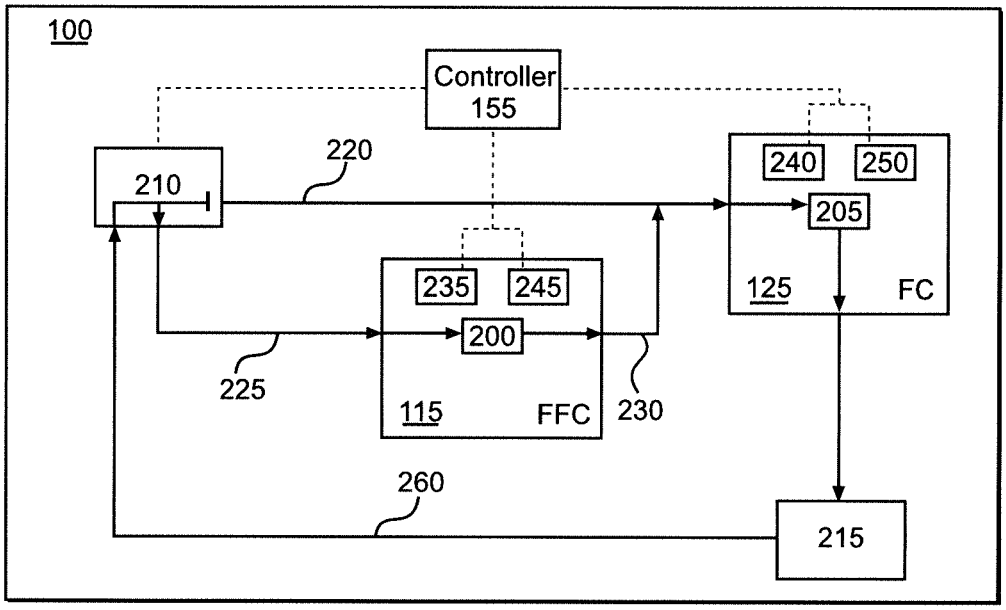
FIG. 2B is a schematic illustrating the appliance in a section operational mode.

FIGS. 2A and 2B show is a schematic view of appliance 100 with a portion of the refrigeration system shown. As discussed above in connection with FIG. 1 and represented in FIGS. 2A and 2B, appliance 100 includes first compartment 115 and second compartment 125. In addition, appliance 100 includes a first evaporator 200 associated with first compartment 115 and a second evaporator 205 associated with second compartment 125. A valve 210 controls the flow of refrigerant from a compressor 215 to first evaporator 200 and second evaporator 205. In particular, valve 210 has at least two positions. In the first position, as shown in FIG. 2A, refrigerant travels along a first line 220 from valve 210 directly to second evaporator 205 without passing through first evaporator 200. In the second position, as shown in FIG. 2B, refrigerant travels along a second line 225 from valve 210 to first evaporator 200. Refrigerant then travels from first evaporator 200 to second evaporator 205 along a third line 230 and first line 220. As a result, when valve 210 is in the first position, second compartment 125 is cooled and, when valve 210 is in the second position, first compartment 115 and second compartment 125 are both cooled. Specifically, this cooling is accomplished through the use of a first fan 235 and a second fan 240, which force air through or past first evaporator 200 and second evaporator 205, respectively, in synchronization with the operation of valve 210 (i.e., first fan 235 is operated while refrigerant flows through first evaporator 200 and second fan 240 is operated while refrigerant flows through second evaporator 205). This chilled air is then circulated through compartments 115 and 125 to cool compartments 115 and 125. In contrast with certain prior art arrangements where first and second evaporators are only arranged in series, the arrangement shown in FIG. 2A allows refrigerant to be sent to second evaporator 205 without first passing through first evaporator 200. As a result, second compartment 125 can be more effectively targeted for extra cooling if necessary.

Appliance 100 further includes a first temperature sensor 245 and a second temperature sensor 250 that measure the temperature of the air in first compartment 115 and second compartment 125, respectively. A controller (or control system or CPU) 155 is electrically coupled, either wired or wirelessly, to at least valve 210, fans 235 and 240 and temperature sensors 245 and 250. Controller 155 receives temperature data from temperature sensors 245 and 250 and uses this data to operate valve 210 and fans 235 and 240, as described in more detail below. Of course, it should be recognized that controller 155 can be electrically coupled to and control other components of appliance 100 (e.g., compressor 215, a user interface, lighting, etc.). It should also be recognized that certain components typically included in an appliance refrigeration system are not shown in FIG. 2. Such components are usually included in an appliance constructed in accordance with the present invention as well but have been omitted for simplicity. These components can include, for example, a condenser, drier and one or more check valves. Typically, the condenser and drier would be provided between compressor 215 and valve 210 (i.e., along a fourth line 260). In addition, although evaporators 200 and 205 are illustrated as being located within compartments 115 and 125, this need not be the case. Instead, evaporators 200 and 205 can simply be associated with compartments 115 and 125 such that, in combination with fans 235 and 240 and associated ductwork (not shown), evaporators 200 and 205 are used to supply chilled air to compartments 115 and 125, respectively. In any case, the general operation of such refrigeration systems is well known in the art such that certain additional details have been omitted for brevity.

Figure 3:
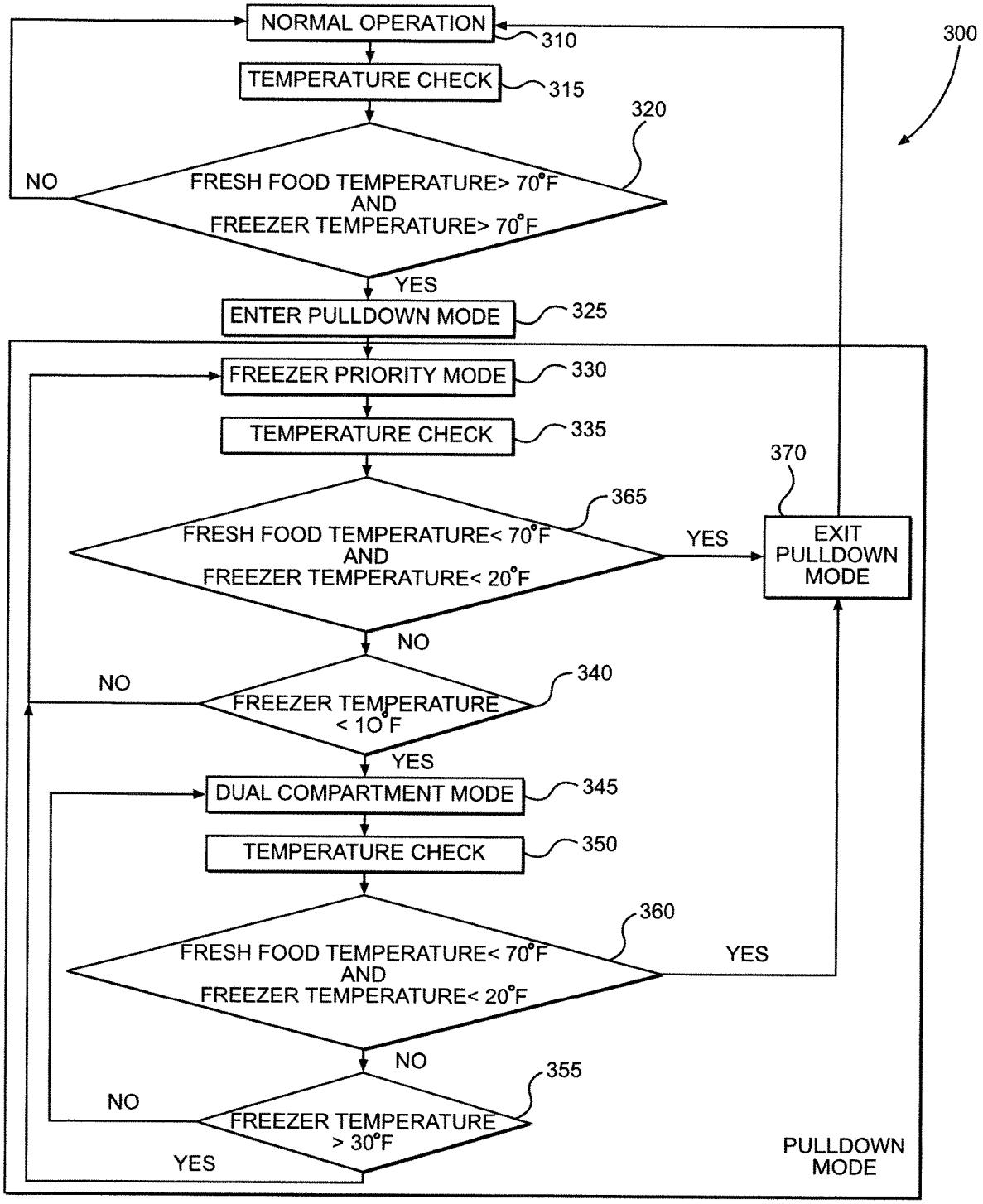
FIG. 3 is a diagram of an appliance control scheme in accordance with the present invention.

With reference now to FIG. 3, an appliance control scheme 300 in accordance with the present invention is illustrated. Initially, appliance 100 is assumed to be operating normally 310. Since the present invention is not focused on the normal operation of appliance 100, it will not be detailed herein. Rather, for purposes of the present invention, normal operation is simply intended to encompass the operation of appliance 100 outside of a pulldown mode, which is described below. For example, in connection with appliance 100, normal operation 310 can involve valve 210 being placed in the second position where refrigerant flows to both first evaporator 200 and second evaporator 205, as shown in FIG. 2B. Controller 155 causes fans 235 and 240 and compressor 215 to be cycled on and off in synchronization (typically on a set schedule) to regulate cooling of compartments 115 and 125. During normal operation of appliance 100, the temperatures of compartments 115 and 125 are periodically or continuously checked at 315 by controller 210 using sensors 245 and 250. If the temperatures of first compartment 115 and second compartment 125 exceed at least one predetermined temperature at 320, the pulldown mode is entered at 325. If not, appliance 100 continues operating normally. Preferably, a single predetermined temperature of approximately 70° F. is employed (although it does not need to be the same for first compartment 115 and second compartment 125). Accordingly, it should be recognized that the pulldown mode is not typically entered except when, for example, appliance 100 is first turned on after purchase, appliance 100 loses power or is turned off for an extended period of time, or a substantial amount of warm food or beverages are loaded into appliance 100. As such, the pulldown mode can be entered right after appliance 100 is turned on (e.g., immediately following a startup routine and temperature check) prior to any normal operation of appliance 100.

When the pulldown mode is first entered, cooling of second compartment 125 is prioritized at 330. Accordingly, controller 155 sends a signal to valve 210 causing valve 210 to enter the first position, shown in FIG. 2A, where refrigerant flows only to second evaporator 205 through first line 220. Controller 155 also sends signals to fans 235 and 240, as necessary, with the result that first fan 235 is stopped and second fan 240 is operated. In this second compartment priority mode 330, the temperature of second compartment 125 is periodically or continuously checked at 335 by controller 210 using second temperature sensor 250. If the temperature of second compartment 125 falls below a predetermined value at 340 (preferably approximately 10° F.), appliance 100 remains in the pulldown mode but switches at 345 to cooling both first compartment 115 and second compartment 125, as shown in FIG. 2B. Otherwise, appliance 100 remains in the freezer priority mode. To cool both first compartment 115 and second compartment 125, controller 155 sends a signal to valve 210 causing valve 210 to enter the second position where refrigerant flows to both first evaporator 200 and second evaporator 205 through second line 225 and third line 230. Controller 155 also sends signals to fans 235 and 240, as necessary, with the result that both of fans 235 and 240 are operated. In this dual compartment mode 345, controller 210 continues to periodically or continuously check the temperature at 350 of second compartment 125 using second temperature sensor 250. If the temperature of second compartment 125 rises above a predetermined value (preferably approximately 30° F.) at 355, appliance 100 switches back to the second compartment priority mode 330. Otherwise, appliance 100 continues cooling both first compartment 115 and second compartment 125. This cycling between the second compartment priority and dual compartment modes continues until the pulldown mode is exited.

In addition to checking the temperature of second compartment 125 during the pulldown mode, controller 210 also periodically or continuously checks the temperature of first compartment 115 using first temperature sensor 245. If the temperature of first compartment 115 is below a predetermined value (preferably approximately 70° F.) at the same time that the temperature of second compartment 125 is below another predetermined value (preferably approximately 20° F.) at 360, 365, appliance 100 exits the pulldown mode at 370 and resumes normal operation. As discussed above, normal operation of appliance 100 can involve controller 155 sending a signal to valve 210 to cause valve 210 to enter the second position where refrigerant flows to both first evaporator 200 and second evaporator 205. Controller 155 also sends signals to fans 235 and 240, as necessary, with the result that both of fans 235 and 240 are operated. Accordingly, both first compartment 115 and second compartment 125 are cooled. This cooling is regulated by cycling fans 235 and 240 and compressor 215 on and off in synchronization (typically on a set schedule). Of course, it should be recognized that if first compartment 115 and second compartment 125 were already being cooled when the pulldown mode was exited, no changes to valve 210 or fans 235 and 240 would be necessary.

Based on the above, it should be readily apparent that the present invention provides an improved pulldown mode that utilizes a particular refrigeration system arrangement and pulldown strategy in order to provide faster pulldown performance and allow for better management of the individual appliance compartments while reducing costs and software complexity. Although described with reference to preferred embodiments, it should be readily understood that various changes or modifications could be made to the invention without departing from the spirit thereof In general, the invention is only intended to be limited by the scope of the following claims.

The invention claimed is:

1. A method of controlling an appliance configured to operate in a normal mode and a pulldown mode, the appliance including a first compartment, a second compartment, a first temperature sensor, a second temperature sensor, a valve, a first evaporator associated with the first compartment and a freezer evaporator associated with the second compartment, the method comprising:

determining a temperature of the first compartment with the first temperature sensor;

determining a temperature of the second compartment with the second temperature sensor;

causing the appliance to enter the pulldown mode when the temperature of the first compartment is above a first predetermined value and the temperature of the second compartment is above a second predetermined value;

upon entering the pulldown mode, causing the valve to enter a first position where refrigerant flows directly from the valve to the freezer evaporator;

causing the valve to enter a second position where refrigerant flows to the freezer evaporator and the first evaporator when the temperature of the second compartment is below a third predetermined value while the appliance is in the pulldown mode and the valve is in the first position; and causing the valve to enter the first position when the temperature of the second compartment is above a fourth predetermined value while the appliance is in the pulldown mode and the valve is in the second position, wherein the fourth predetermined value is different from the second predetermined value.

2. The method of claim 1, wherein the first and second predetermined values are approximately equal.

3. The method of claim 1, wherein the first compartment is a fresh food compartment, the second compartment is a freezer compartment, and the first predetermined value is 70° F. or the second predetermined value is approximately 70° F.

4. The method of claim 1, wherein the third predetermined value is less than the fourth predetermined value.

5. The method of claim 4, wherein the third and fourth predetermined values are less than the first and second predetermined values.

6. The method of claim 4, wherein the third predetermined value is approximately 10° F., and the fourth predetermined value is approximately 30° F.

7. The method of claim 1, further comprising, while the appliance is in the pulldown mode:

causing the appliance to exit the pulldown mode when the temperature of the first compartment is below a fifth predetermined value and the temperature of the second compartment is below a sixth predetermined value; and upon exiting the pulldown mode, causing the valve to enter the second position.

8. The method of claim 7, wherein the fifth predetermined value is greater than the sixth predetermined value.

9. The method of claim 8, wherein the fifth predetermined value is approximately 70° F., and the sixth predetermined value is approximately 20° F.

10. An appliance configured to operate in a normal mode and a pulldown mode, comprising:

a first compartment;

a second compartment;

a first temperature sensor configured to determine a temperature of the first compartment;

a second temperature sensor configured to determine a temperature of the second compartment;

a first evaporator associated with the first compartment;

a freezer evaporator associated with the second compartment;

a valve configured to control a flow of refrigerant to the first evaporator and the freezer evaporator; and a controller configured to:

cause the appliance to enter the pulldown mode when the temperature of the first compartment is above a first predetermined value and the temperature of the second compartment is above a second predetermined value;

upon entering the pulldown mode, cause the valve to enter a first position where refrigerant flows directly from the valve to the freezer evaporator;

cause the valve to enter a second position where refrigerant flows to the freezer evaporator and the first evaporator when the temperature of the second compartment is below a third predetermined value while the appliance is in the pulldown mode and the valve is in the first position; and cause the valve to enter the first position when the temperature of the second compartment is above a fourth predetermined value while the appliance is in the pulldown mode and the valve is in the second position, wherein the fourth predetermined value is different from the second predetermined value.

11. The appliance of claim 10, wherein the appliance is a refrigerator, the first compartment is a fresh food compartment and the second compartment is a freezer compartment.

12. The appliance of claim 10, wherein the first and second predetermined values are approximately equal.

13. The appliance of claim 10, wherein the first compartment is a fresh food compartment, the second compartment is a freezer compartment, and the first predetermined value is 70° F. or the second predetermined value is approximately 70° F.

14. The appliance of claim 10, wherein the third predetermined value is less than the fourth predetermined value.

15. The appliance of claim 14, wherein the third and fourth predetermined values are less than the first and second predetermined values.

16. The appliance of claim 15, wherein the first predetermined value is approximately 70° F., the second predetermined value is approximately 70° F., the third predetermined value is approximately 10° F., and the fourth predetermined value is approximately 30° F.

17. The appliance of claim 10, wherein the controller is further configured to:

cause the appliance to exit the pulldown mode when the temperature of the first compartment is below a fifth predetermined value and the temperature of the second compartment is below a sixth predetermined value while the appliance is in the pulldown mode; and upon exiting the pulldown mode, cause the valve to enter the second position.

18. The appliance of claim 17, wherein the fifth predetermined value is greater than the sixth predetermined value.

* * * * *